United States Patent [19]

Ranson

[11] Patent Number: 4,955,282

[45] Date of Patent: Sep. 11, 1990

[54] UNIFORM FLOW HYDRAULIC SYSTEM

[76] Inventor: Ronald W. Ranson, 125 Merrimont Dr., Hueytown, Ala. 35023

[21] Appl. No.: 328,876

[22] Filed: Mar. 27, 1989

[51] Int. Cl.[5] ..... F15B 11/08; F15B 13/04

[52] U.S. Cl. ..... 91/436; 92/108; 92/110; 92/165 R; 91/440

[58] Field of Search ..... 92/51, 108, 110, 111, 92/112, 163, 165 R; 91/152, 156, 167, 436, 480

[56] References Cited

U.S. PATENT DOCUMENTS

| | | | |
|---|---|---|---|
| 3,259,026 | 7/1966 | Madland et al. | 91/436 |
| 3,353,352 | 11/1967 | Gardner | 92/108 |
| 3,357,451 | 12/1967 | Tennis | 91/436 |
| 3,452,397 | 1/1969 | Newton | 91/436 |
| 3,559,537 | 2/1971 | Faure | 92/108 |
| 3,858,485 | 1/1975 | Rosaen et al. | 92/108 |
| 4,205,591 | 6/1980 | Mickelson | 91/436 |
| 4,269,283 | 5/1981 | Bramberger et al. | 92/51 |
| 4,343,226 | 8/1982 | de Almeida | 92/108 |
| 4,750,408 | 6/1988 | Stoll | 92/51 |

FOREIGN PATENT DOCUMENTS

| | | | |
|---|---|---|---|
| 406298 | 3/1965 | Australia | 92/51 |
| 1193898 | 6/1965 | German Democratic Rep. | 92/108 |
| 2547013 | 4/1977 | German Democratic Rep. | 92/108 |
| 2726165 | 12/1977 | German Democratic Rep. | 91/436 |
| 0113611 | 7/1983 | Japan | 92/108 |

*Primary Examiner*—Carl D. Price
*Assistant Examiner*—Thomas Denion
*Attorney, Agent, or Firm*—Jennings, Carter, Thompson & Veal

[57] ABSTRACT

A multi-chamberal hydraulic cylinder and valve system utilizes a single relatively low flow rate pump to provide pressurized fluid during travel, compression and retraction of the piston rod. The piston rod has an effective diameter greater than its physical diameter due to the additional forces applied on an annular piston which is also used to extend and retract the piston rod without supplying pressurized fluid to the interior of the hollow piston rod except during the compression portion of the stroke.

6 Claims, 2 Drawing Sheets

UNIFORM FLOW HYDRAULIC SYSTEM

FIELD OF THE INVENTION

The present invention relates to improved hydraulic ram systems and more particularly to a ram system wherein a large compression force is required to be exerted at the end of a long displacement stroke. In even greater particularity the present invention relates to a system wherein the pressurized fluid flow rate is uniform throughout the cycle of operation of a hydraulic ram which can be extended over a large low force stroke.

BACKGROUND OF THE INVENTION

In various applications, such as refuse compactors, baling equipment, and the like, fluid actuated linear rams are used to compress a product for transportation, storage, or further processing. Oftentimes it is necessary for the ram to travel a considerable distance in a pre-compression or non-compression mode, wherein the ram is being extended to close the gap between its retracted position and the product to be compressed, or the ram is being retracted to allow introduction of additional product. In a conventional application by way of example, an 8" diameter ram may be moved over a 150 inch stroke with only the last 15 inches in the compression region. In a typical single acting cylinder the fluid pump would deliver pressurized fluid to the ram over the entire stroke, yet compression pressure is needed only over a small portion of the stroke. It has been common to provide the main ram with a plurality of separate cylinders aligned about the ram to move the ram during the non-compression portions of the stroke. As will be understood by those familiar with hydraulic systems, the pressure and flow of the hydraulic fluid in such systems is generally unbalanced, so that on the compression stroke the pump may be required to provide ten times the volume of pressurized fluid as is required on the retraction stroke. This obviously leads to heat dissipation problems and places a severe limitation on pump requirements in the system. Also, the use of auxiliary cylinders as slaves or positioning cylinders requires additional space, maintenance and installation expense.

In U.S. Pat. No. 3,949,650 Blatt et al disclosed a cylinder construction wherein a concentric inner and outer chamber were formed with the inner chamber receiving pressurized fluid during the compression stroke and the outer cylinder receiving pressurized fluid during the retraction stroke. The area of the inner and outer cylinders were equal, thus the demands on the pump were somewhat lessened, however the ram sacrificed some of its compression capacity to achieve this result. That is to say, a 4" ram built in accordance with Blatt's teachings would be about the size of a 5½" ram of conventional design and would have a total compression force of only one-half the conventional ram. Also the Blatt et al design does not indicate any recognition of the need to move the rod outside the compression region.

SUMMARY OF THE INVENTION

It is the object of the present invention to provide a hydraulic system which has a large displacement stroke within which a relatively small compression stroke is utilized and wherein fluid pressure and flow rate for moving the ram in each direction remains uniform throughout the cycle of operation.

Yet another object of the invention is to reduce the size of the pump needed to perform iterative operation of such a device.

Yet another object of the invention is to reduce the heat dissipation needed in such a system.

Still another object of the invention is to provide a single acting retractable ram with the above advantages which is also compact in size.

Yet another object of the invention is to reduce the complexity and cost of such devices.

These and other objects and advantages of my invention are accomplished through the use of a concentric multi-chamberal cylinder wherein the individual internal chambers can work individually or in unison to move a ram or apply a compressive force. In my multi-chambered cylinder I utilize a central fixed chamber which has an axial port through which fluid may pass in accordance with the setting of a valve. This valve will, in some instances, provide connection with a reservoir of fluid at atmospheric pressure or may provide connection to a source of pressurized fluid. The multi-chamberal cylinder includes an annular chamber concentric with the central fixed chamber. The annular chamber is divided into a travel chamber and a return chamber by a piston which carries a hollow piston rod, the interior of which communicates with the central chamber. The travel and return chambers are serviced by a directional valve which selectively connects them to pressurized or unpressurized hydraulic fluid.

In this system only the annular chamber need be pressurized to move the piston rod in the non-compression area of the stroke, thus only a relatively low volume of pressurized fluid is needed, hence the flow rate is about equal. However, at the compression region, pressurized fluid may be applied within both the annular travel chamber and the central chamber thereby providing the force of a piston having a larger diameter than that of the piston rod.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
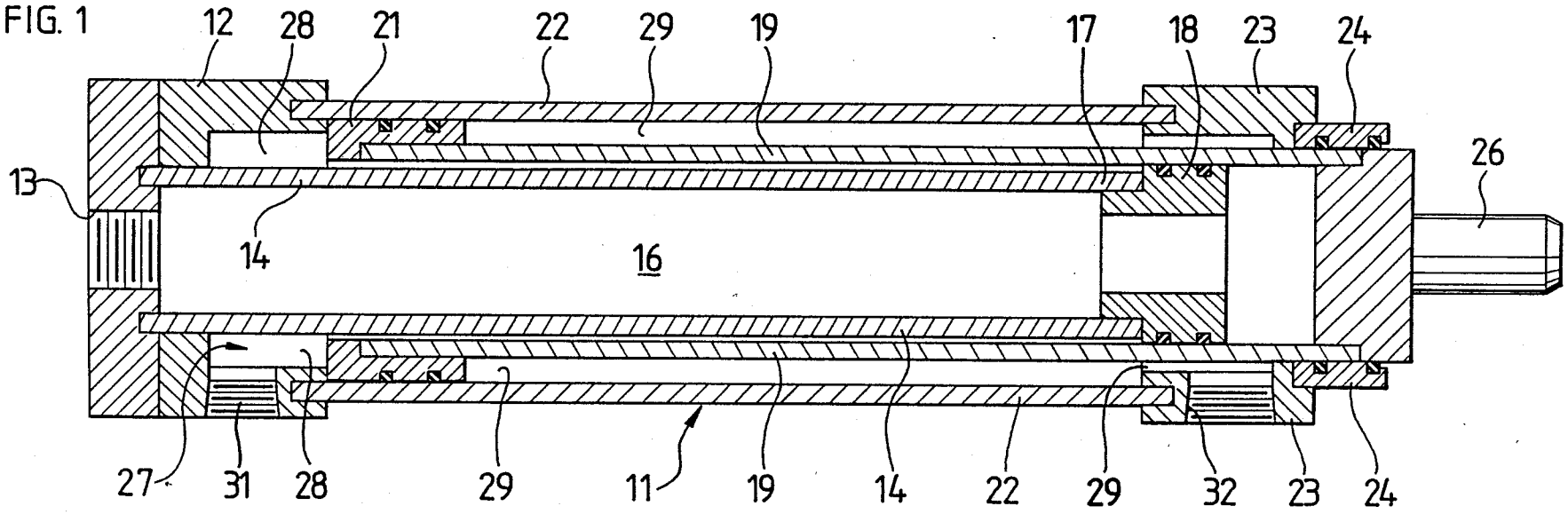
FIG. 1 is a sectional view of my multi-chamberal cylinder with the piston rod fully retracted.
Figure 2:
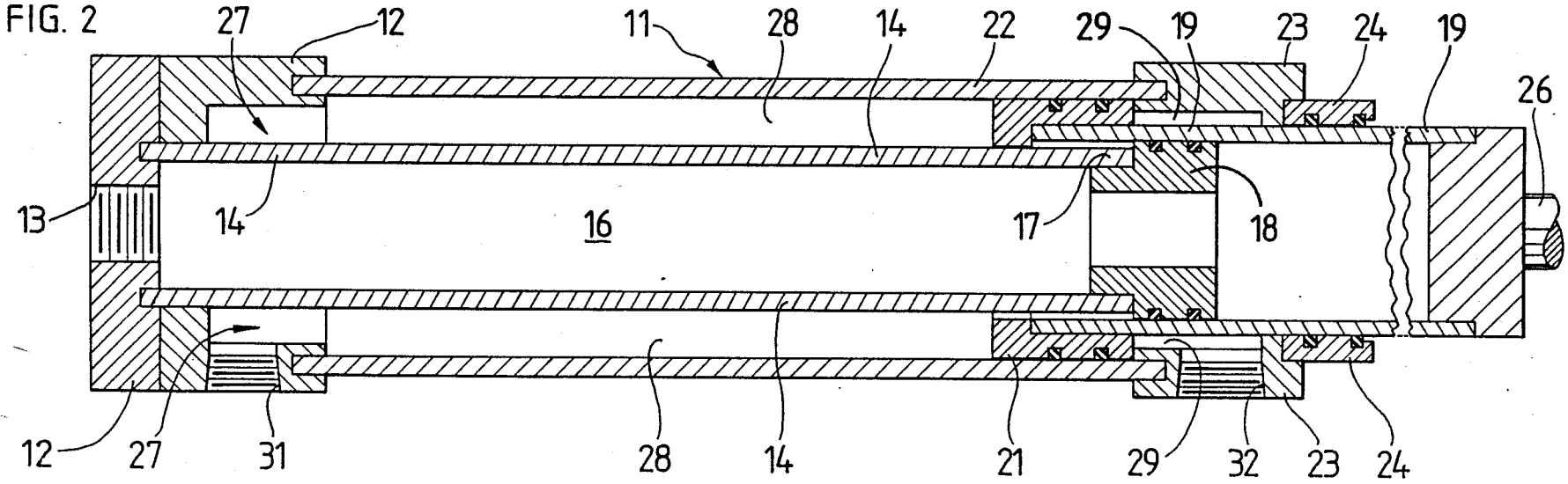
FIG. 2 is a sectional view of my multi-chamberal cylinder with the piston rod fully extended.

Referring to the drawings for a better understanding of the invention, it can be seen in FIGS. 1 & 2 that the cylinder portion of my invention is a multi-chamberal cylinder 11 which includes a blind end head 12 which will be mounted to a stationary structure such as a wall or beam or frame of a truck. The blind end head has a central port 13 which is axially aligned with a stationary inner rod tube 14 secured to blind end head 12 and which defines a fixed portion of an elongated central chamber 16. Inner rod tube 14 has an end 17 distal the blind end head 12 which has secured thereto an annular seal 18 sealingly engaging the inner surface of a hollow piston rod 19 which is mounted concentrically with inner rod tube 14 and extends beyond the annular seal 18. An annular piston 21 is secured to the inner end of the piston rod 19 and seals outwardly against the interior of a stationary outer rod tube 22, which is fixed to blind end head 12 and is concentric with the inner rod tube 14, and piston rod 19.

The outer rod tube 22 is affixed at its other end to an annular rod end head 23 carrying an annular rod bearing and seal 24 which engages the outer surface of piston rod 19. The piston rod 19 is closed on its outer end to support the ram 26. It may thus be seen that an annular chamber 27 is formed between the inner and outer stationary rod tubes 12 and 22 and the annular chamber 27 is segregated into a travel chamber 28 and a return chamber 29 by the piston rod 19 and piston 21. Note that the internal diameter of the piston rod is such that the work area of the piston rod itself is greater than the work area of either annular face of the piston 21. By way of example, a cylinder employing my construction may be constructed having an inner tube 14 with an internal diameter of 3.0 inches, a piston rod 19 with an internal diameter of 3.5 inches and an outer tube 22 with an internal diameter of 5.0 inches. The effective work area of the piston rod would be about 38.5 square inches; the area of the travel chamber face of the piston 21 would be 40.04 square inches, and the work area of the return face of piston 21 would be about 28.28 square inches. The combined work area utilized in the compression zone would be about 78.5 square inches. The blind end head 12 has formed thereon a radial port 31 which accesses travel chamber 28, a similar radial port 32 accessing return chamber 29 is formed in the rod end head 23.

Figure 3:
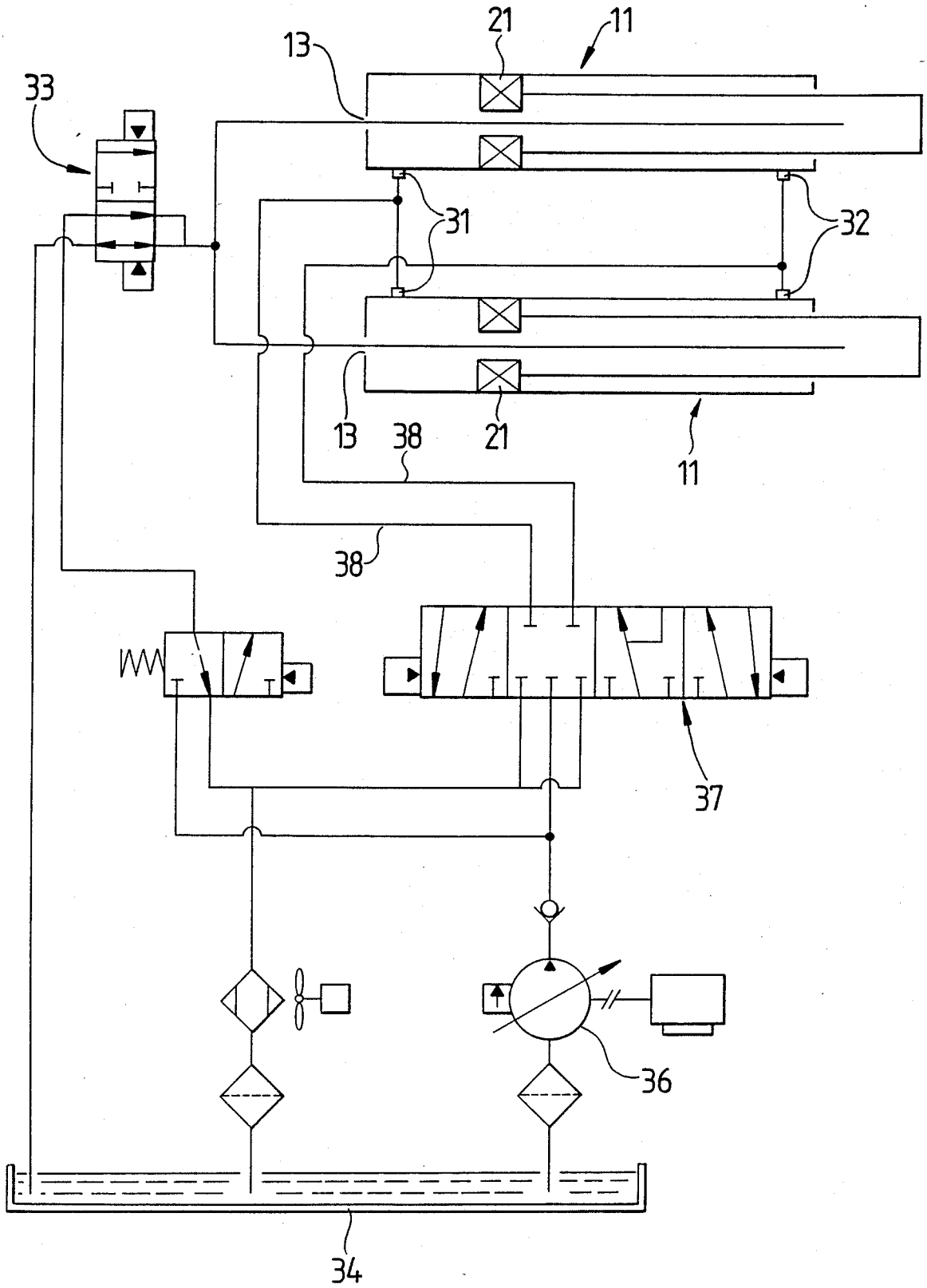
FIG. 3 is a schematic diagram of my hydraulic circuit set up in a dual ram system.

Referring to FIG. 3, it may be seen that the axial ports 13 of the cylinder are connected to a valve 33 which is a directional control valve or a prefill valve. Valve 33 is a two position valve which allows unimpeded flow of hydraulic fluid between internal chamber 16 and a reservoir 34 of hydraulic fluid normally maintained at atmospheric pressure in one position or allows pressurized fluid into the chamber 16 from a pump 36 in its other position.

Ports 31 and 32 are connected to a separate valve 37 which is also a directional control valve such as a four position valve. Valve 37 is connected to the ports 31, 32, the pump 36, and the reservoir 34 by appropriate conduits 38 such that in one position chamber 28 is connected to reservoir 34 and chamber 29 is connected to the output side of pump 36, thus pressurized fluid is applied to piston 21 to retract the ram 26 from its extended position and hydraulic fluid from chambers 16 and 28 is returned to the reservoir. In a second position both ports 31 and 32 are closed and the ram is static; in a third position chamber 28 receives pressurized fluid from pump 36 to urge piston 21 to the extended position, thus forcing fluid from chamber 29, which fluid is added to the pressurized fluid and returns to the cylinder in chamber 28. Fluid is simultaneously aspirated from the reservoir into chamber 16. This position of valves 37 and 33 permits the piston rod to extend without the application of full compressive force. In the final position of valve 37 pressurized fluid is applied to chamber 28 via port 31 and displaced fluid from chamber 29 exits via port 32 to the reservoir. Simultaneously, port 13 is opened via valve 33 to admit pressurized fluid from pump 36 to chamber 16, thus maximal force is applied to the ram for compression. It may be seen that during the travel and retraction strokes pressurized fluid is supplied only to the annular chamber 28 and 29, thus a relatively small pump is capable of providing adequate flow and pressure. In the system described above, a 45 gallon/min., 3000 psi pump can adequately handle the flow and pressure requirements of what is effectively a 10 inch piston rod having a stroke of 150 inches and a duty cycle of retraction and regeneration of about 70 seconds. It will be appreciated that various circuit elements such as coolers and filters are included and a plurality of sensors and controls may be employed to automatically change the position of the valves to properly cycle the cylinder.

While I have shown my invention in one form, it will be obvious to those skilled in the art that it is not so limited but is susceptible of various changes and modifications without departing from the spirit thereof.

What I claim is:

1. A hydraulic compression system comprising:

(a) a blind end head affixed to a stationary inner rod tube and a stationary outer rod tube, said inner and outer rod tubes being concentric and spaced apart and said blind end head having an axial port communicating with the interior of said inner rod tube and a radial port communicating with a first annular region between said inner and outer rod tubes;

(b) a hollow piston rod mounted for linear reciprocal motion within said first annular region and extending therefrom;

(c) a piston carried on the inner end of said hollow piston rod in sliding sealed engagement with the inner surface of said outer rod tube such that an annular return chamber is formed between said piston rod and said outer rod tube;

(d) an annular seal carried by said inner rod tube providing a sliding seal between said inner rod tube and the inside of said piston rod such that an annular travel chamber is formed between said inner rod tube and said outer rod tube;

(e) a rod end head having an axial bore through which said piston rod may retract and extend while maintaining a sliding seal therewith, said rod end head having a radial port communicating with said travel chamber between said hollow piston rod and said outer rod tube; and (f) a hydraulic system including a reservoir, at ambient pressure, a single pump having a pressurized output, and valve means for selectively applying high pressure fluid only in said travel chamber while aspirating fluid from said reservoir through said axial port in an extension mode, applying high pressure fluid to said travel chamber and said axial port in a compression mode, and applying high pressure fluid only to said return chamber in a retraction made whereby the flow rate from said pump remains approximately uniform for each mode.

2. A hydraulic compression system as defined in claim 1 wherein said valve means comprises:

(a) a directional valve connected to said radial port of said blind head and said radial port of rod end head by a first and second hydraulic line respectively, and having an input connection to the pressurized output of said pump, and a connection to said reservoir, said directional valve, providing connection between said pump output and said annular travel chamber region in said extension mode and said compression mode and connection between said pump output and said annular return chamber in said retraction mode; and (b) a directional valve having a connection to said pump output and said reservoir and providing connection between said pump and said axial port in said compression mode, and said reservoir and said axial bore in said retraction mode.

3. Apparatus as defined in claim 1 wherein said stationary inner rod tube is different in cross-sectional area than said travel chamber or said return chamber.

4. Apparatus as defined in claim 2 further comprising a third directional valve operatively connected between said axial port and said reservoir to selectively permit fluid flow through said axial port.

5. Apparatus as defined in claim 4 wherein an elongated chamber is different in cross-sectional area than said annular travel or said annular return chamber.

6. A method for driving a hydraulic ram over an extended stroke to achieve maximum compression with a constant flow rate pump comprising:

(a) forming an elongated central chamber within a hydraulic ram;

(b) forming an elongated annular chamber about said elongated central chamber;

(c) mounting a hollow piston rod for reciprocal motion along said annular chamber with said piston rod sealingly engaging the interior of said annular chamber to divide said annular chamber into a travel chamber and a retraction chamber;

(d) selectively applying pressurized hydraulic fluid to said travel chamber while aspirating ambient pressure hydraulic fluid into said central chamber to fill said central chamber as said piston rod travels;

(e) applying pressurized hydraulic fluid to said travel chamber and said central chamber to obtain maximum compression;

(f) applying pressurized fluid to said retraction chamber to urge said piston rod inwardly; and (g) iteratively repeating said applying steps to position said piston rod for compression, to apply maximum force, and to retract said piston rod.

* * * * *